US007302920B2

(12) United States Patent
Lou

(10) Patent No.: US 7,302,920 B2
(45) **Date of Patent: *Dec. 4, 2007**

(54) VARIABLE VALVE ACTUATOR

(76) Inventor: Zheng Lou, 11200 Fellows Creek Dr., Plymouth, MI (US) 48170

( * ) Notice: Subject to any disclaimer, the term of this patent is extended or adjusted under 35 U.S.C. 154(b) by 42 days.

This patent is subject to a terminal disclaimer.

(21) Appl. No.: 11/154,039

(22) Filed: Jun. 16, 2005

(65) Prior Publication Data

US 2006/0283408 A1 Dec. 21, 2006

(51) Int. Cl.
*F01L 9/02* (2006.01)

(52) U.S. Cl. ..... 123/90.12; 123/90.13

(58) Field of Classification Search ..... 123/90.12, 123/90.13; 251/12, 30.2
See application file for complete search history.

(56) References Cited

U.S. PATENT DOCUMENTS

| | | | | |
|---|---|---|---|---|
| 4,930,464 A | | 6/1990 | Letsche | 123/90.12 |
| 5,248,123 A | | 9/1993 | Richeson et al. | 251/29 |
| 5,577,468 A | * | 11/1996 | Weber | 123/90.12 |
| 5,595,148 A | | 1/1997 | Letsche et al. | 123/90.12 |
| 5,765,515 A | | 6/1998 | Letsche | 123/90.12 |
| 5,809,950 A | | 9/1998 | Letsche et al. | 123/90.12 |
| 6,082,243 A | | 7/2000 | Schumucker | |
| 6,167,853 B1 | | 1/2001 | Letsche | 123/90.12 |
| 6,491,007 B1 | | 12/2002 | Kubel et al. | 123/90.12 |
| 6,601,552 B2 | | 8/2003 | Kubel et al. | 123/90.12 |
| 6,948,462 B2 | * | 9/2005 | Engelberg | 123/90.12 |
| 7,086,358 B2 | * | 8/2006 | Panciroli | 123/90.12 |
| 7,156,058 B1 | * | 1/2007 | Lou | 123/90.12 |
| 7,194,991 B2 | * | 3/2007 | Lou | 123/90.12 |

* cited by examiner

*Primary Examiner*—Ching Chang
(74) *Attorney, Agent, or Firm*—Gifford, Krass, Sprinkle, Anderson & Citkowski, PC

(57) ABSTRACT

Actuators, and corresponding methods and systems for controlling such actuators, provide independent lift and timing control with minimum energy consumption. In an exemplary embodiment, an actuation cylinder in a housing defines a longitudinal axis and having first and second ends in first and second directions. An actuation piston in the cylinder, with first and second surfaces, is moveable along the longitudinal axis. First and second actuation springs bias the actuation piston in the first and second directions, respectively. A first fluid space is defined by the first end of the actuation cylinder and the first surface of the actuation piston, and a second fluid space is defined by the second end of the actuation cylinder and the second surface of the actuation piston. A fluid bypass short-circuits the first and second fluid spaces when the actuation piston is not substantially proximate to either the first or second end of the actuation cylinder. A first flow mechanism is provided in fluid communication between the first fluid space and a first port, and a second flow mechanism is provided in fluid communication between the second fluid space and a second port. The term "fluid" includes both liquids and gases, and the actuator may be coupled to a stem to form a variable valve actuator in an internal combustion engine, for example.

22 Claims, 13 Drawing Sheets

VARIABLE VALVE ACTUATOR

FIELD OF THE INVENTION

This invention relates generally to actuators and corresponding methods and systems for controlling such actuators, and in particular, to actuators providing independent lift and timing control with minimum energy consumption.

BACKGROUND OF THE INVENTION

Various systems can be used to actively control the timing and lift of engine valves to achieve improvements in engine performance, fuel economy, emissions, and other characteristics. Depending on the means of the control or the actuator, these systems can be classified as mechanical, electrohydraulic, and electromechanical (sometimes called electromagnetic). Depending on the extent of the control, they can be classified as variable valve-lift and timing, variable valve-timing, and variable valve-lift. They can also be classified as cam-based or indirect acting and camless or direct acting.

In the case of a cam-based system, the traditional engine cam system is kept and modified somewhat to indirectly adjust valve timing and/or lift. In a camless system, the traditional engine cam system is completely replaced with electrohydraulic or electro-mechanical actuators that directly drive individual engine valves. All current production variable valve systems are cam-based, although camless systems will offer broader controllability, such as cylinder and valve deactivation, and thus better fuel economy.

Problems with an electromechanical camless system include difficulty associated with soft-landing, high electrical power demand, inability or difficulty to control lift, and limited ability to deal with high and/or varying cylinder air pressure. An electrohydraulic camless system can generally overcome such problems, but it does have its own problems such as performance at high engine speeds and design or control complexity, resulting from the conflict between the response time and flow capability. To operate at up to 6,000 to 7,000 rpm, an actuator has to first accelerate and then decelerate an engine valve over a range of 8 mm within a period of 2.5 to 3 milliseconds. The engine valve has to travel at a peak speed of about 5 m/s. These requirements have stretched the limit of conventional electrohydraulic technologies.

One way to overcome this performance limit is to incorporate, in an electrohydraulic system like in an electromechanical system, a pair of opposing springs which work with the moving mass of the system to create a spring-mass resonance or pendulum system. In the quiescent state, the opposing springs center an engine valve between its end positions, i.e., the open and closed positions. To keep the engine valve at one end position, the system has to have some latch mechanism to fight the net returning force from the spring pair, which accumulates potential energy at either of the two ends. When traveling from one end position to the other, the engine valve is first driven and accelerated by the spring returning force, powered by the spring-stored potential energy, until the mid of the stroke where it reaches its maximum speed and possesses the associated kinetic energy; and it then keeps moving forward fighting against the spring returning force, powered by the kinetic energy, until the other end, where its speed drops to zero, and the associated kinetic energy is converted to the spring-stored potential energy.

With its well known working principle, this spring-mass system by itself is very efficient in energy conversion and reliable. Much of the technical development has been to design an effective and reliable latch-release mechanism which can hold the engine valve to its open or closed position, release it as desired, add additional energy to compensate for frictions and highly variable engine cylinder air pressure, and damp out extra energy before its landing on the other end. As discussed above, there have been difficulties associated with electromechanical or electromagnetic latch-release devices. There has also been effort in the development of electrohydraulic latch-release devices.

Disclosed in U.S. Pat. No. 4,930,464, assigned to DaimlerChrysler, is an electrohydraulic actuator including a double-ended rod cylinder, a pair of opposing springs that tends to center the piston in the middle of the cylinder, and a bypass that short-circuits the two chambers of the cylinder over a large portion of the stroke where the hydraulic cylinder does not waste energy. When the engine valve is at the closed position, the bypass is not in effect, the piston divides the cylinder into a larger open-side chamber and a smaller closed-side chamber, and the engine valve can be latched when the open-side and closed-side chambers are exposed to high and low pressure sources, respectively, because of the resulting differential pressure force on the piston in opposite to the returning spring force. When the engine valve is at the open position, the piston divides the cylinder into a larger closed-side chamber and a smaller open-side chamber, and the engine valve can be latched by exposing a larger closed-side chamber and smaller open-side chamber with high and low pressure sources, respectively.

At either open or closed position, the engine valve is unlatched by briefly opening a 2-way trigger valve to release the pressure in the larger chamber and thus eliminate the differential pressure force on the piston, triggering the pendulum dynamics of the spring-mass system. The 2-way valve has to be closed very quickly again, before the stroke is over, so that the larger chamber pressure can be raised soon enough to latch the piston and thus the engine valve at its new end position. This configuration also has a 2-way boost valve to introduce extra driving force on the top end surface of the valve stem during the opening stroke.

The system just described has several potential problems. The 2-way trigger valve has to be opened and closed in a timely manner within a very short time period, no more than 3 ms. The 2-way boost valve is driven by differential pressure inside the two cylinder chambers, or stroke spaces as the inventers refer as, and there is potentially too much time delay and hydraulic transient waves between the boost valve and cylinder chambers. Near the end of each stroke, the larger cylinder chamber has to be back-filled by the fluid fed through a restrictor, which demands a fairly decent opening size on the part of the restrictor. On the other hand, at the onset of the each stroke, the 2-way trigger valve has to relieve the larger chamber which is in fluid communication with the high pressure fluid source through the same restrictor. During a closing stroke, there is no effective means to add additional hydraulic energy until near the very end of the stroke, which may be a problem if there are too much frictional losses. Also, this invention does not have means to adjust its lift.

DaimlerChrysler has also been assigned U.S. Pat. Nos. 5,595,148, 5,765,515, 5,809,950, 6,167,853, 6,491,007, and 6,601,552, which disclose improvements to the teachings of U.S. Pat. No. 4,930,464. The subject matter up to U.S. Pat. No. 6,167,853 resulted in various hydraulic spring means to add additional hydraulic energy at the beginning of the opening stroke to overcome engine cylinder air pressure force. One drawback of the hydraulic spring is its rapid pressure drop once the engine valve movement starts.

In U.S. Pat. No. 6,601,552, a pressure control means is provided to maintain a constant pressure in the hydraulic spring means over a variable portion of the valve lift, which however demands that the switch valve be turned between two positions within a very short period time, say 1 millisecond. The system again contains two compression springs: a first and second springs tend to drive the engine valve assembly to the closed and open positions, respectively. The hydraulic spring means is physically in serial with the second compression spring. During a substantial portion of an opening stroke, it is attempted to maintain the pressure in the hydraulic spring despite of the valve movement and thus provide additional driving force to overcome the engine cylinder air pressure and other friction, resulting in a net fluid volume increase in the hydraulic spring means and an effective preload increase in the second compression spring because of a force balance between the hydraulic and compression springs. In the following valve closing stroke, the engine valve may not be pushed all the way to a full closing because of higher resistance from the second compression spring.

A concern common to this entire family of inventions is that there have to be two switchover actions of the control valve for each opening or closing stroke. Another common issue is the length of the actuator with the two compression springs separated by a hydraulic spring. When the springs are aligned on the same axis, as disclosed in U.S. Pat. No. 5,809,950, the total height may be excessive. In the remaining patents of this family, the springs are not aligned on a straight axis, but are instead bent at the hydraulic spring, and the fluid inertia, frictional losses, and transient hydraulic waves and delays may become serious problems. Another common problem is that the closing stroke is driven by the spring pendulum energy only, and an existence of substantial frictional losses may pose a serious threat to the normal operation. As to the unlatching or release mechanism, some embodiments use a 3-way trigger valve to briefly pressurize the smaller chamber of the cylinder to equalize the pressure on both surfaces of the piston and reduce the differential pressure force on the piston from a favorable latching force to zero. Still the trigger valve has to perform two actions within a very short period of time.

U.S. Pat. No. 5,248,123 discloses another electrohydraulic actuator including a double-ended rod cylinder, a pair of opposing springs that tends to center the piston in the middle of the cylinder, and a bypass that short-circuits the two chambers of the cylinder over a large portion of the stroke where the hydraulic cylinder does not waste energy. Much like the referenced DaimlerChrysler patents, it has the larger chamber of the hydraulic cylinder connected to the high pressure supply all the time. Different from DaimlerChrysler, however, it uses a 5-way 2-position valve to initiate the valve switch and requires only one valve action per stroke. The valve has five external hydraulic lines: a low-pressure source line, a high-pressure source line, a constant high-pressure output line, and two other output lines that have opposite and switchable pressure values. The constant high pressure output line is connected with the larger chamber of the cylinder. The two other output lines are connected to the two ends of the cylinder and are selectively in communication with the smaller chamber of the cylinder. Much like the DaimlerChrysler disclosures, it has no effective means to add hydraulic energy at the beginning of a stroke to compensate for the engine cylinder air force and friction losses. It is not capable of adjusting valve lift either.

SUMMARY OF THE INVENTION

Briefly stated, in one aspect of the invention, one preferred embodiment of an electrohydraulic actuator comprises an actuator housing, a actuation cylinder in the actuator housing, a longitudinal axis defined by the actuation cylinder with a first and second directions, an actuation piston disposed in the actuation cylinder and moveable along the longitudinal axis in the first and second directions, and first and second ports in the actuator housing. The actuation cylinder comprises first and second ends. The actuation piston comprises first and second surfaces. One preferred embodiment further comprises a first piston rod connected to the first surface of the actuation piston and disposed slideably inside a first bearing distal to the first end of the actuation cylinder, and a second piston rod connected to the second surface of the actuation piston and disposed slideably inside a second bearing distal to the second end of the actuation cylinder, a first fluid space defined by the first end of the actuation cylinder and the first surface of the actuation piston, a second fluid space defined by the second end of the actuation cylinder and the second surface of the actuation piston, a bypass means that hydraulically short-circuits the first and second fluid spaces when the actuation piston is not proximate to either of the first or second end of the actuation cylinder, a first flow mechanism between the first fluid space and the first port, a second flow mechanism between the second fluid space and the second port, first and second actuation springs biasing the actuation piston in the first and second directions, an engine valve operably connected to the second piston rod, and one or more snubbing means.

The actuation piston can be latched to the first end of the actuation cylinder, such that with the engine valve in a closed position, when the second and first fluid spaces are exposed to high- and low-pressure fluid, respectively, and not short-circuited by the bypass means because the resulting differential pressure force on the piston is in opposite to and greater than a returning force from the first and second actuation spring. Likewise, the actuation piston can be latched to the second end of the actuation cylinder, such that with the engine valve in an open position, when the first and second fluid spaces are exposed to high- and low-pressure fluid, respectively, and not short-circuited by the bypass means.

At either open or closed position, the engine valve is unlatched or released by toggling an actuation switch valve so that the pressure levels in the first and second fluid spaces are reversed, instead of being equalized as in the prior art, and thus the differential pressure force on the piston is also reversed, instead of just being reduced to almost zero like in prior art. Before the switch, the differential pressure force on the actuation piston is in opposite to and greater than the spring returning force to latch the engine valve. After the switch, the differential pressure force keeps substantially the same magnitude and reverses its direction to help the spring returning force drive the engine valve to the other position, feeding additional hydraulic energy into the system.

In one preferred embodiment, the bypass means comprises one or more passages embedded in the housing and with openings to the fluid spaces. In an alternative embodiment, the bypass means is simply an undercut around the cylinder wall.

According to the invention, the engine valve is initialized to the closed position by supply high pressure fluid to a chamber under a start piston fixed on the first piston rod. Alternatively, the engine valve is initialized to the open position by supply high pressure fluid into a chamber directly above the first piston rod. In yet another alternative embodiment, a start shaft assembly is used to selectively close and disable the bypass means so that the actuation piston and cylinder system can be directly used for its own startup. Also, by blocking the bypass means with this start shaft assembly, the actuator can be operated selectively with a much smaller lift.

The present invention provides significant advantages over other actuators and valve control systems, and methods for controlling actuators and/or engine valves. For example, by adding a substantial hydraulic force to coincide with the spring returning force at the beginning of each stroke, the system can help overcome the engine-cylinder air pressure and compensate for frictional losses. The ability of an alternative preferred embodiment to provide a shorter valve lift is very beneficial to achieve efficient low load operation in certain engine control strategies. The present invention is able to incorporate lash adjustment into all alternative preferred embodiments. It is also possible to trigger and complete one engine valve stroke by just one, instead of two, switch actions of the actuation switch valve.

The present invention, together with further objects and advantages, will be best understood by reference to the following detailed description taken in conjunction with the accompanying drawings.

DETAILED DESCRIPTION OF THE INVENTION

Figure 1:
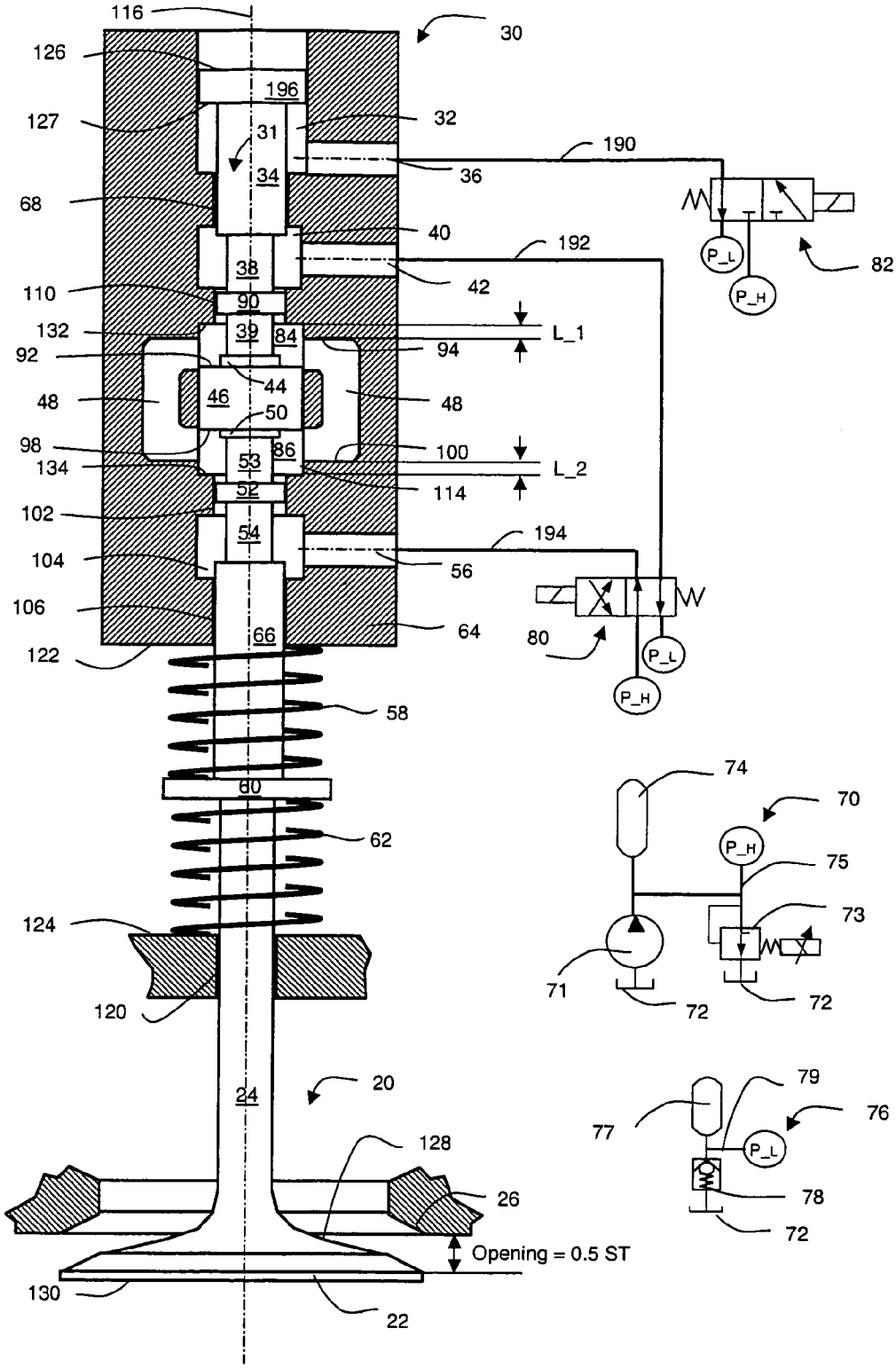
FIG. 1 is a schematic illustration of one preferred embodiment of the hydraulic actuator and hydraulic supply system.

Referring now to FIG. 1, a preferred embodiment of the invention provides an engine valve control system using two pistons, one or more bypass passages, and a pair of spring means. The system comprises an engine valve 20, a hydraulic actuator 30, a high-pressure hydraulic source 70, a low-pressure hydraulic assembly 76, an actuation switch valve 80, and a start switch valve 82.

The high-pressure hydraulic source 70 includes a hydraulic pump 71, a high-pressure regulating valve 73, a high-pressure accumulator or reservoir 74, a high-pressure supply line 75, and a hydraulic tank 72. The high-pressure hydraulic source 70 provides necessary hydraulic flow at a high-pressure P_H. The hydraulic pump 71 circulates hydraulic fluid from the hydraulic tank 72 to the rest of the system through the high-pressure supply line 75. The high-pressure P_H is regulated through the high-pressure regulating valve 73. The high-pressure accumulator 74 helps smooth out pressure and flow fluctuation and is optional depending on the total system capacity or elasticity, flow balance, and/or functional needs. The hydraulic pump 71 can be either of a variable- or fixed-displacement type, with the former being more energy efficient. The high-pressure regulating valve 73 may be able to vary the high-pressure value for functional needs and/or energy efficiency.

The low-pressure hydraulic assembly 76 includes a low-pressure accumulator or reservoir 77, the hydraulic tank 72, a low-pressure regulating valve 78, and a low-pressure line 79. The low-pressure hydraulic assembly 76 accommodates exhaust flows at a back-up or low-pressure P_L. The low-pressure line 79 takes all exhaust flows back to the hydraulic tank 72 through the low-pressure regulating valve 78. The low-pressure regulating valve 78 is to maintain a design or minimum value of the low-pressure P_L. The low-pressure P_L is elevated above the atmosphere pressure to facilitate back-filling without cavitation and/or over-retardation. The low-pressure regulating valve 78 can be simply a spring-loaded check valve as shown in FIG. 1 or an electrohydraulic valve if more control is desired. The low-pressure accumulator 77 helps smooth out pressure and flow fluctuation and is optional depending on the total system capacity or elasticity, flow balance, and/or functional needs.

The actuation switch valve 80 and start switch valve 82 supply the ports of the hydraulic actuator 30 with proper flow supply lines. The start switch valve 82 shown in FIG. 1 is a 2-position 3-way valve. It is 3-way because it has three external hydraulic lines that include two input lines, i.e., low pressure P_L and high pressure P_H, and a fluid line 190. It is 2-position because it has two stable control positions symbolized by left and right blocks or positions in FIG. 1. The left position is secured by the action of a return spring when a solenoid is not energized, and it is also called the default position. The right position is secured by energizing the solenoid. At the left and right positions, the valve 82 connects the fluid line 190 with the low-pressure P_L and high-pressure P_H lines, respectively.

Following the same conventions, the actuation switch valve 80 is a 2-position 4-way valve. It has four external hydraulic lines: a low-pressure P_L line, a high-pressure P_H line, a fluid line 192 and a fluid line 194. Its default position is the right position secured by a return spring, and its other position is the left position forced by a solenoid. At its default or right position, the valve 80 connects the fluid lines 192 and 194 with the low pressure P_L and high pressure P_H lines, respectively. The connection order is switched when the valve 80 is at its left position.

The engine valve 20 includes an engine valve head 22 and an engine valve stem 24. The engine valve 20 is mechanically connected with and driven by the hydraulic actuator 30 along a longitudinal axis 116 through the engine valve stem 24, which is slideably disposed in the engine valve guide 120. When the engine valve 20 is fully closed, the engine valve head 22 is in contact with an engine valve seat 26, sealing off the air flow in/out of the associated engine cylinder.

The hydraulic actuator 30 comprises an actuator housing 64, within which, along the longitudinal axis 116 and from a first to a second direction (from the top to the bottom in the drawing), there are a start cylinder 32, a first bearing 68, a first chamber 40, a first control bore 110, an actuation cylinder 114, a second control bore 102, a second chamber 104, and a second bearing 106. Within these hollow elements from the first to the second direction lies a shaft assembly 31 comprising a start piston 196, a first piston rod 34, a first shoulder 44, an actuation piston 46, a second shoulder 50, a second piston rod 66, and a spring seat 60. The first piston rod 34 further comprises a first-piston-rod second neck 38, a first land 90, and a first-piston-rod first neck 39. The second piston rod 66 further comprises a second-piston-rod first neck 53, a second land 52, and a second-piston-rod second neck 54.

In the actuation cylinder 114, there is a first fluid space 84 defined by the actuation cylinder first end 132 and the actuation piston first surface 92 and a second fluid space 86 defined by the actuation cylinder second end 134 and the actuation piston second surface 98.

The shaft assembly 31 can be substantially radially supported by some or all of the following mating surfaces from the first to the second direction: the start piston 196 and the start cylinder 32, the first piston rod 34 and the first bearing 68, the actuation piston 46 and the actuation cylinder 114, and the second piston rod 66 and the second bearing 106. Each pair of the above listed mating surfaces has tight clearance, provides substantial hydraulic seal, and yet offers tolerable resistance to relative motions, including translation along and, if desired, rotation around the longitudinal axis 116, between the shaft assembly 31 and the housing 64. The start cylinder 32 communicates hydraulically with the start switch valve 82 through a start port 36 and the fluid line 190. The actuation switch valve 80 communicates with the first chamber 40 through a first port 42 and the fluid line 192 and with the second chamber 104 through a second port 56 and the fluid line 194.

Through the side wall of the actuation cylinder 114, there are one or more bypass passages 48, which provide a hydraulic short circuit over a substantial length of the actuation cylinder 114. The bypass passages 48 are preferably arranged in such a way that there is on the actuation piston 46 minimum net side force due to hydraulic static pressure. With the hydraulic short circuit, fluid may flow with substantially low resistance between the first and second fluid spaces 84 and 86, and the entire actuation cylinder 114 is at substantially equal pressure. The hydraulic short circuit is not effective either when the actuation piston first surface 92 is distal, in the first direction, to the bypass first edge 94 or the actuation piston second surface 98 is distal, in the second direction, to the bypass second edge 100. The longitudinal distance between the bypass first edge 94 and the actuation cylinder first end 132 is L_1. The longitudinal distance between the bypass second edge 100 and the actuation cylinder second end 134 is L_2.

The first land 90, the first control bore 110, and the first-piston-rod first and second necks 39 and 38 work together as a flow mechanism. The first land 90 selectively blocks fluid flow between the first chamber 40 and the first fluid space 84 of the actuation cylinder 114, which occurs when the first land 90 is longitudinally located in or overlaps the first control bore 110, with the radial clearance between the first land 90 and the first control bore 110 being substantially small and restrictive to fluid flow. The second land 52, the second control bore 102, and the second-piston-rod first and second necks 53 and 54 work together as another flow mechanism. The second land 52 selectively blocks fluid flow between the second chamber 104 and the second fluid space 86 of the actuation cylinder 114, which occurs when the second land 52 is longitudinally located in or overlaps the second control bore 102, with the radial clearance between the second land 52 and the second control bore 102 being substantially small and restrictive to fluid flow.

The longitudinal locations of the first land 90 and the second land 52 along the shaft assembly 31 are such that each of the two lands 90 and 52 blocks fluid flow when the actuation piston 46 sits or travels in-between the bypass first and second edges 94 and 100, i.e., the bypass passages 48 being in effect. This prevents an open flow, through the bypass passages 48, between the first chamber 40 and the second chamber 104 and saves energy. When the bypass passages 48 are not effective, the two lands 90 and 52 disengage or underlap their respective control bores 110 and 102 and allow substantial flow between the first chamber 40 and the first fluid space 84 and between the second chamber 104 and the second fluid space 86.

The lengths of the actuation piston 46 and cylinder 114 are designed such that the piston 46 can travel with a stroke of ST plus an allowance for the engine valve lash adjustment. When moving in the second direction and opening the engine valve, the actuation piston 46 stops when its second surface 98 hits the actuation cylinder second end 134. When moving in the first direction and closing the engine valve, the engine valve head 22 hits the valve seat 26 first while there is still a distance L_lash (see FIG. 3) or less between the actuation piston first surface 92 and the actuation cylinder first end 132. The distance L_lash is allowance for the engine valve lash adjustment. Preferably, the sum of the lengths L_1 and L_2 is substantially less than the valve stroke ST to minimize the loss of hydraulic energy.

The first and second shoulders 44 and 50 are intended to work together with the first and second control bores 110 and 102 as snubbers to provide damping of the shaft assembly 31 near the end of the travel in the first and second directions, respectively. When traveling in the first direction, the actuation piston 46 pushes hydraulic fluid from the first fluid space 84 to the first chamber 40 once the actuation piston first surface 92 is distal to the bypass first edge 94. At roughly the same time, the first shoulder 44 is pushed into the first control bore 110, resulting in a flow restriction because of a narrower radial clearance between the first shoulder 44 and the first control bore 110 and thus a rising pressure on the actuation piston first surface 92, which slows down the shaft assembly. A similar flow restriction through the radial clearance between the second shoulder 50 and the second control bore 102 helps dampen the motion of the shaft assembly 31 and the engine valve 20 in the second direction.

Concentrically wrapped around the engine valve stem 24 and the second piston rod 66, respectively, are a first actuation spring 62 and a second actuation spring 58. The second actuation spring 58 is supported by the housing surface 122 and the spring seat 60, whereas the first actuation spring 62 is supported by cylinder head surface 124 and spring seat 60. The actuation springs 62 and 58 are always under compression. They are preferably identical in major geometrical, physical and material parameters, such as stiffness, pitch and wire diameters, and free-length, such that the net spring force resulting from the two opposing spring forces is substantially equal to zero at the neutral position shown in FIG. 1.

The spring seat 60 is designed such that when it is located substantially half-way between the housing surface 122 and the cylinder head surface 124 and when the actuation piston 46 is at the longitudinal center of the actuation cylinder 114 as shown in FIG. 1, the two actuation springs 62 and 58 are under equal compression. As such the net spring force is zero, which is also the neutral position of the hydraulic actuator 30, with the engine valve 20 being open at half of its stroke ST. The spring seat 60 also offers a mechanical connection between the shaft assembly 31 and the engine valve 20 or, more specifically or locally, between the second piston rod 66 and the engine valve stem 24.

The shaft assembly 31 is generally under three static hydraulic forces and two spring forces. The three static hydraulic forces are the pressure forces at the actuation piston first and second surfaces 92 and 98 and the start piston second surface 127. The start piston first surface 126 is preferably exposed to the air or a low pressure fluid. In case of a hydraulic leakage around the start piston 196, a passage may be included to channel the leak flow from the top of the piston 196 to the hydraulic tank. The two spring forces are from the two actuation springs 62 and 58 to the spring seat 60.

The engine valve 20 is generally exposed to two air pressure forces on the first surface 128 and the second surface 130 of the engine valve head 22. The hydraulic actuator 30 and the engine valve 20 also experience various friction forces, steady-state flow forces, transient flow forces, and inertia forces. Steady-state flow forces are caused by the static pressure redistribution due to fluid flow or the Bernoulli effect. Transient flow forces are caused by the acceleration of the fluid mass. Inertia forces result from the acceleration of objects, excluding fluid here, with inertia, and they are very substantial in an engine valve assembly because of the large magnitude of the acceleration or the fast timing.

Start-Up

When the power is off, the status of the system is substantially equal to that shown in FIG. 1. Two switch valves 80 and 82 are at their default positions. The start port 36 is connected to the P_L line, and the first port 42 and the second port 56 are connected to the P_L and P_H lines, respectively. Both the P_H and P_L lines are at zero gage pressure because the pump 71 is off. There is no net hydraulic force on the hydraulic actuator 30, and there is no air force on the engine valve 20 either because the engine is not running.

Ignoring the gravitational force, the two springs 62 and 58 have to be compressed equally to keep force balance, resulting in a longitudinally centered position for the spring seat 60 between the housing surface 122 and the cylinder head surface 124, a longitudinally centered position for the actuation piston 46 in the actuation cylinder 114, and a half-open position for the engine valve 20.

At engine start, the hydraulic pump 71 is turned on first to pressurize the hydraulic circuit. During vehicle operation, the hydraulic pump 71 is preferably driven directly by the engine. One may have to use a supplemental electrical means (not shown here) to start the hydraulic pump 71, or to add an electrically-driven supplemental pump (also not shown).

Figure 2:
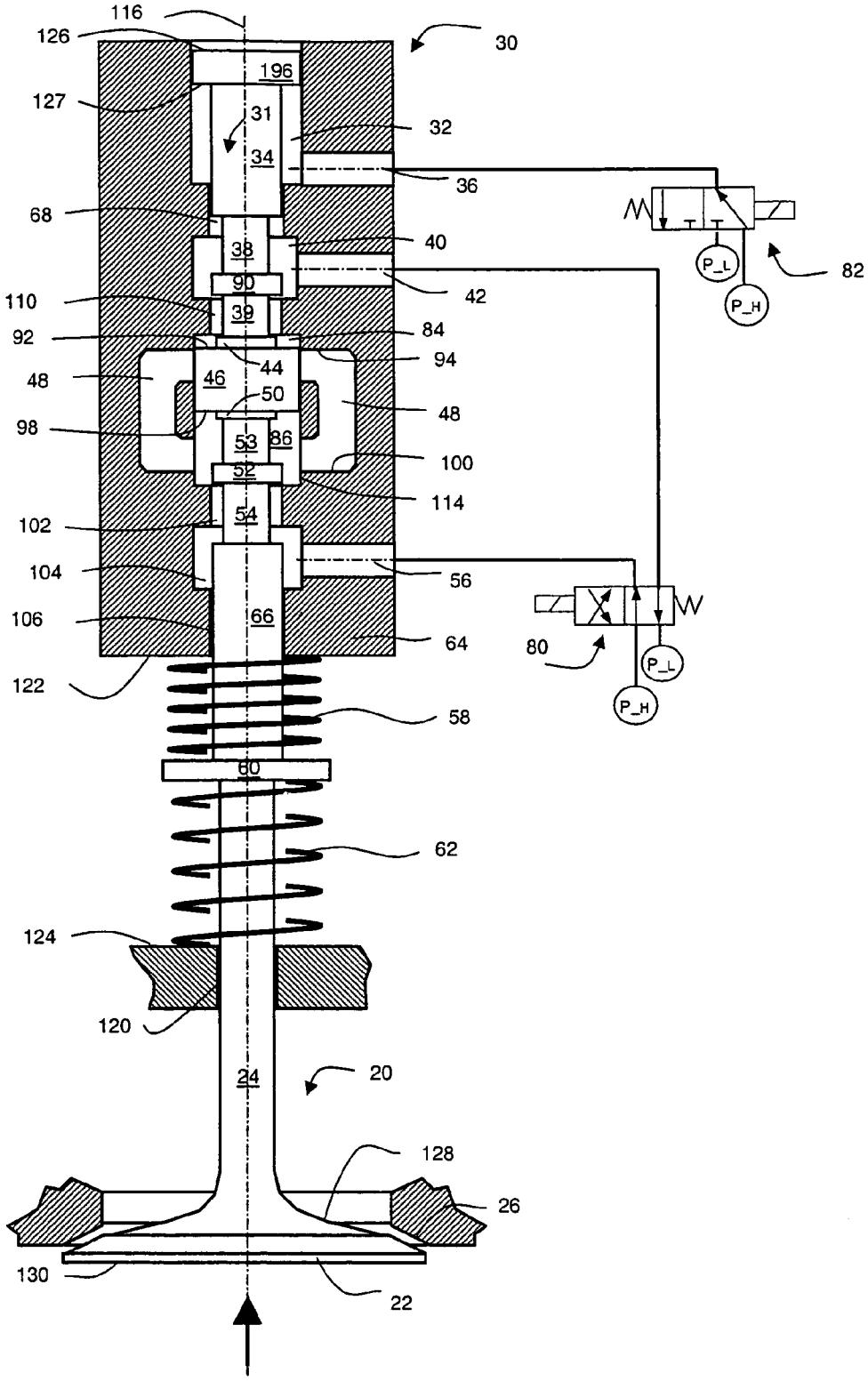
FIG. 2 is a schematic illustration of one preferred embodiment of the hydraulic actuator, which is being initialized. For simplicity, this and rest of the illustrations do not include the hydraulic supply system.

Even with the system pressurized, however, the actuation piston 46 is stationary because its two surfaces 92 and 98 are exposed to substantially the same pressure due to the bypasse(s) 48. Instead, the start switch valve 82 has to be turned to its start or right position as shown in FIG. 2, with the second surface 127 of the start piston 196 being exposed to the high pressure P_H. The start piston 196 thus pulls, in the first direction, the shaft assembly 31 and the engine valve 20, overcoming the net spring force. Note that the actuation switch valve 80 is still in its default or right position as shown in FIG. 2, and it supplies the first chamber 40 and the second chamber 104 with the low pressure P_L and high pressure P_H lines, respectively.

Once the actuation piston first surface 92 travels past the bypass first edge 94, the bypass passages 48 are blocked or disabled, and flows through the first and second control bores 110 and 102 are no longer blocked by the first and second lands 90 and 52, resulting in a driving force in the first direction on the actuation piston 46 with the high pressure P_H and low pressure P_L at its second and first surfaces 98 and 92, respectively. This differential pressure force is set to be strong enough to hold the shaft assembly 31 and the engine valve 20 in the closed position against the spring force even after the start switch valve 82 is switched back to its default or non-start position and supplies only low pressure P_L fluid to the start cylinder 32 as shown in FIG. 3.

Figure 3:
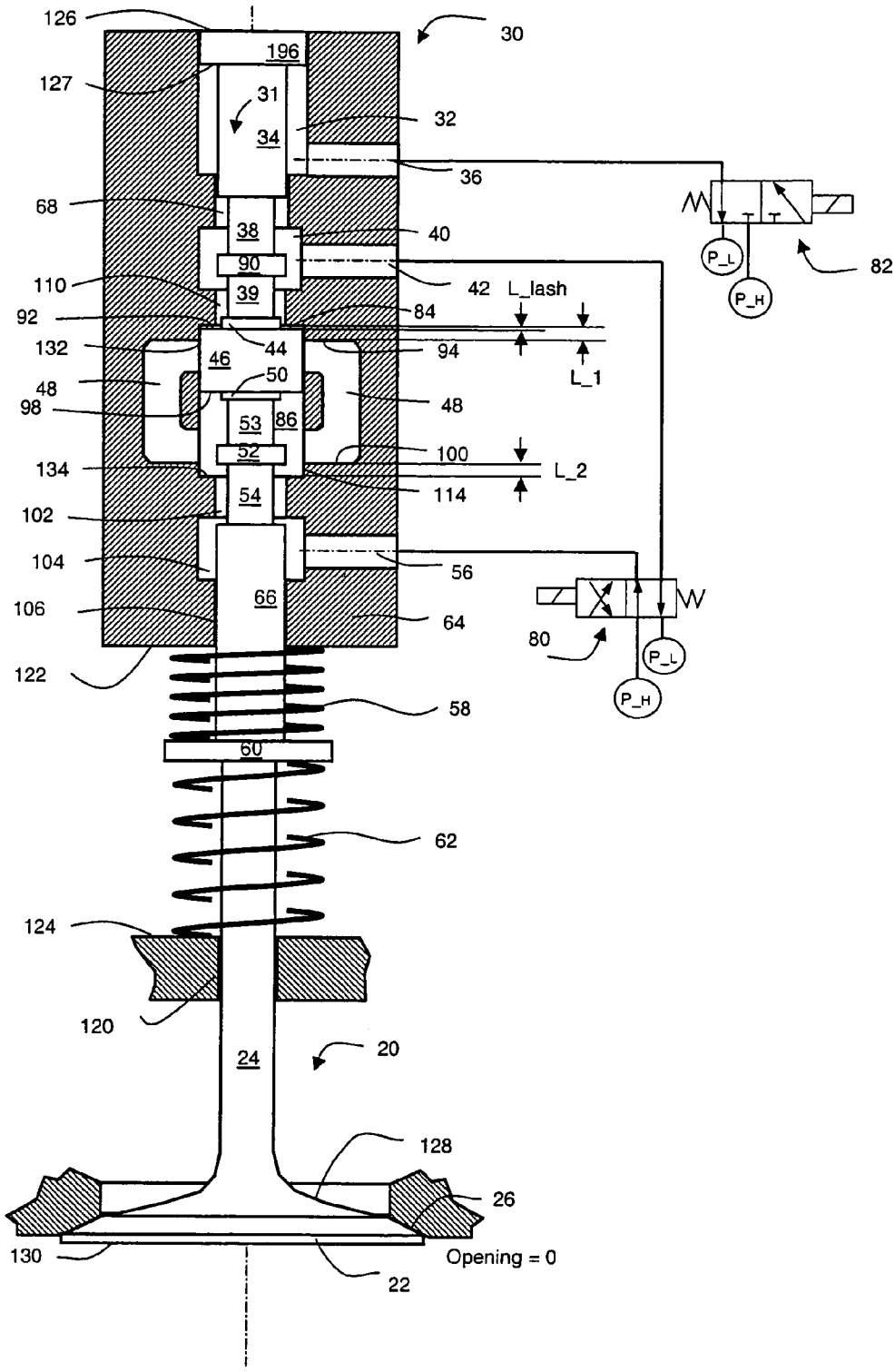
FIG. 3 is a schematic illustration of one preferred embodiment of the hydraulic actuator, which is complete with initialization. The engine valve is in closed position.

At the state shown in FIG. 3, the start-up process is complete, start switch valve 82 will remain in the default or non-start or left position until the next engine starting, and the start cylinder 32 will remain filled with low-pressure fluid and contribute negligible force to hydraulic actuator 31. Due to the back-and-forth movements of the start piston 196 during the normal operation, the pressure inside the start cylinder 32 deviates from the system low-pressure P_L. To prevent unnecessary losses, this deviation can be minimized by having shorter and larger flow passages in the fluid line 190 and the start switch valve 82. The time response requirement for the start-up is generally not as stringent as that for the engine valve switching, the start switch valve 82 can be made with larger openings.

The state in FIG. 3 is a stable state for the engine valve 20, which for a typical engine operation stays closed roughly ¾ of the thermodynamic cycle. For the most of the rest of the cycle, the engine valve 20 travels to the other stable state (the fully open state), stays there, and returns from it.

Valve Opening

Figure 4:
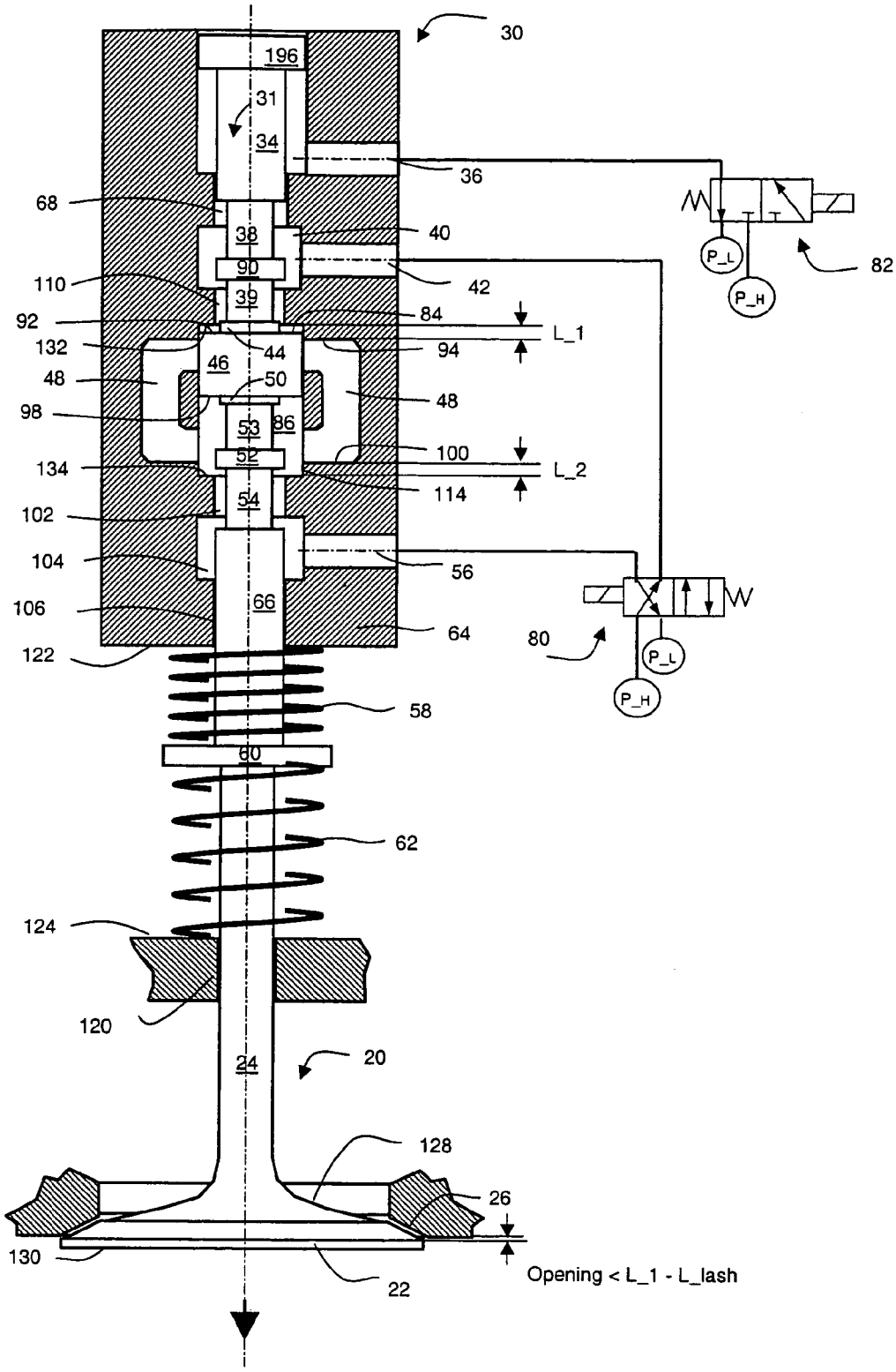
FIG. 4 is a schematic illustration of one preferred embodiment of the hydraulic actuator, with an opening travel just started and with the bypass not in effect.

To open the engine valve 20, the actuation switch valve 80 is turned to the left position as shown in FIG. 4, wherein the first and second chambers 40 and 104 are connected with the high pressure P_H and low pressure P_L, respectively. Due to the open communication through the second control bore 102, the pressure in the second fluid space 86 quickly drops close to the low pressure P_L. Although the first control bore 110 is somewhat restricted by the first shoulder 44, the pressure in the first fluid space 84 still can reach close to the high pressure P_H within a reasonable amount of time because of a low initial piston speed and flow rate. With these actuations, the differential hydraulic force on the actuation piston 46 changes its direction from in the first direction to in the second direction. This hydraulic force in the second direction works with the net spring force in the same direction to accelerate the shaft assembly 31 and the engine valve 20, and also helps overcome whatever engine cylinder air force on the engine valve head 22.

Figure 5:
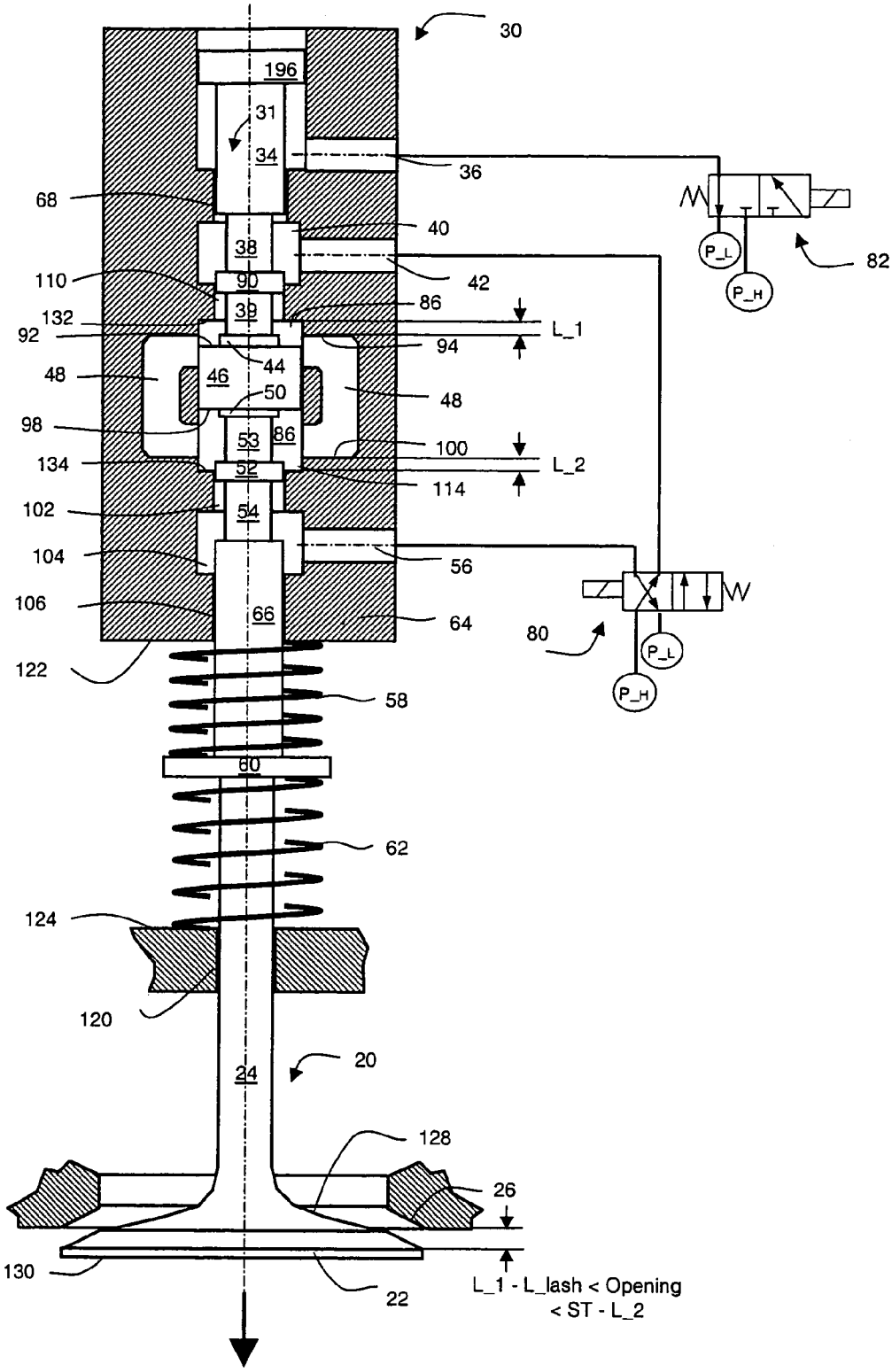
FIG. 5 is a schematic illustration of one preferred embodiment of the hydraulic actuator, with the actuator in the middle range of an opening travel and with the bypass in effect.

When the engine valve opening is between (L_1-L_lash) and (ST-L_2) during the travel in the second direction as shown in FIG. 5, the first and second control bores 110 and 102 are substantially blocked by the first and second lands 90 and 52, respectively, and the displacement of the actuation piston 46 is accomplished by flows through the bypass passages 48. Hydraulic power is no longer used, and the hydraulic actuator 31 is driven primarily by the actuation springs 62 and 58. The potential energy stored in the springs 62 and 58 is released and continues to accelerate the hydraulic actuator 31 and the engine valve 20 until passing through the half-way point of the stroke, when the actuation springs 62 and 58 start resisting the movement in the second direction and converts the kinetic energy into the potential energy.

Figure 6:
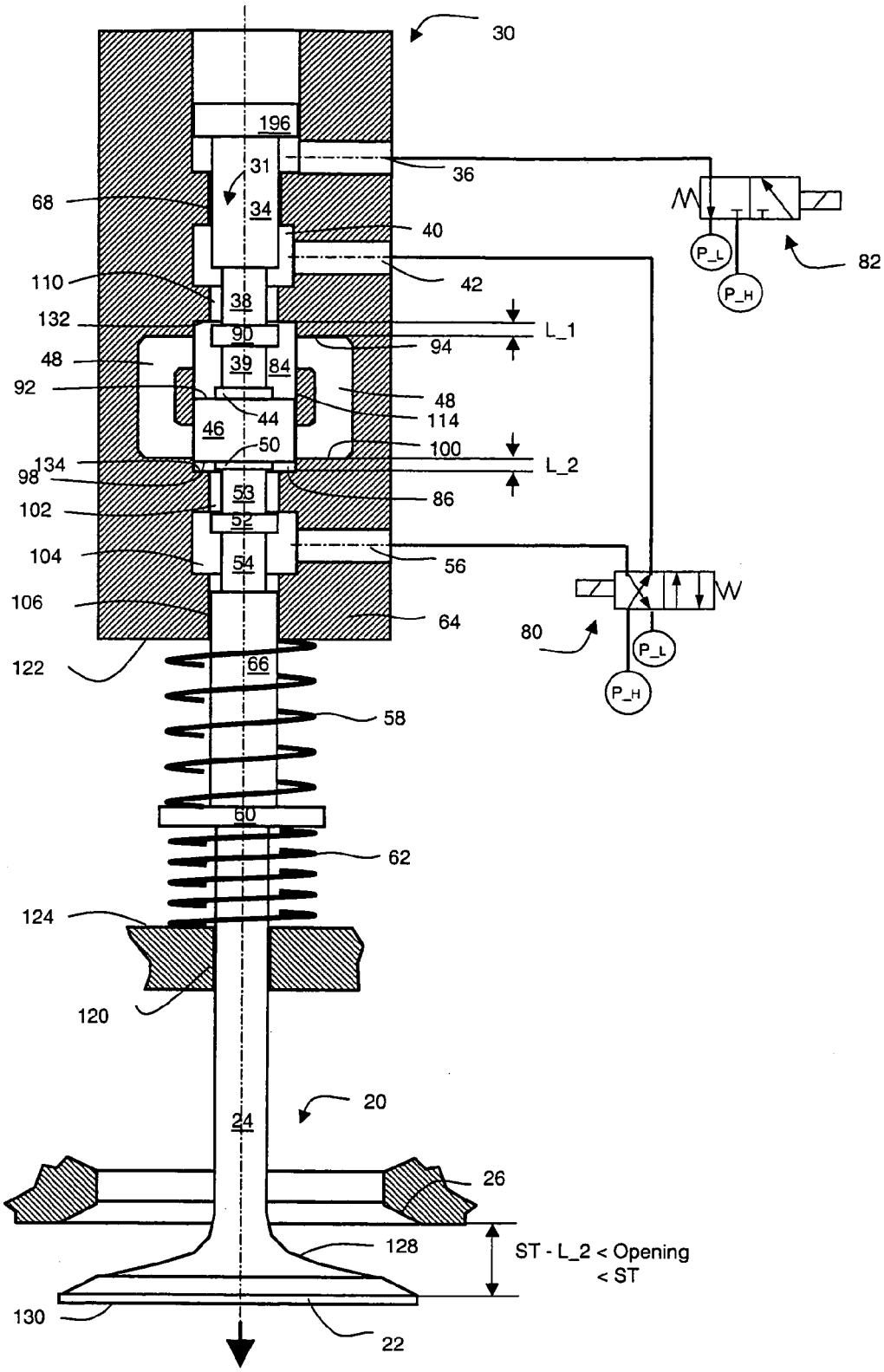
FIG. 6 is a schematic illustration of one preferred embodiment of the hydraulic actuator, with the actuator near the end of an opening travel and with the bypass not in effect.

When the engine valve opening is between (ST-L_2) and ST during a travel in the second direction as shown in FIG. 6, both the first and second control bores 110 and 102 are open for flows. Within this travel range, the net spring force is in the first direction, increases with the travel, and slows down the shaft assembly 31 and engine valve. When the actuation piston second surface 98 just passes the bypass second edge 100, the first and second surfaces 92 and 98 of the actuation piston 46 are now exposed to the high pressure P_H and low pressure P_L, respectively, resulting in a net static hydraulic force in the second direction.

Figure 7:
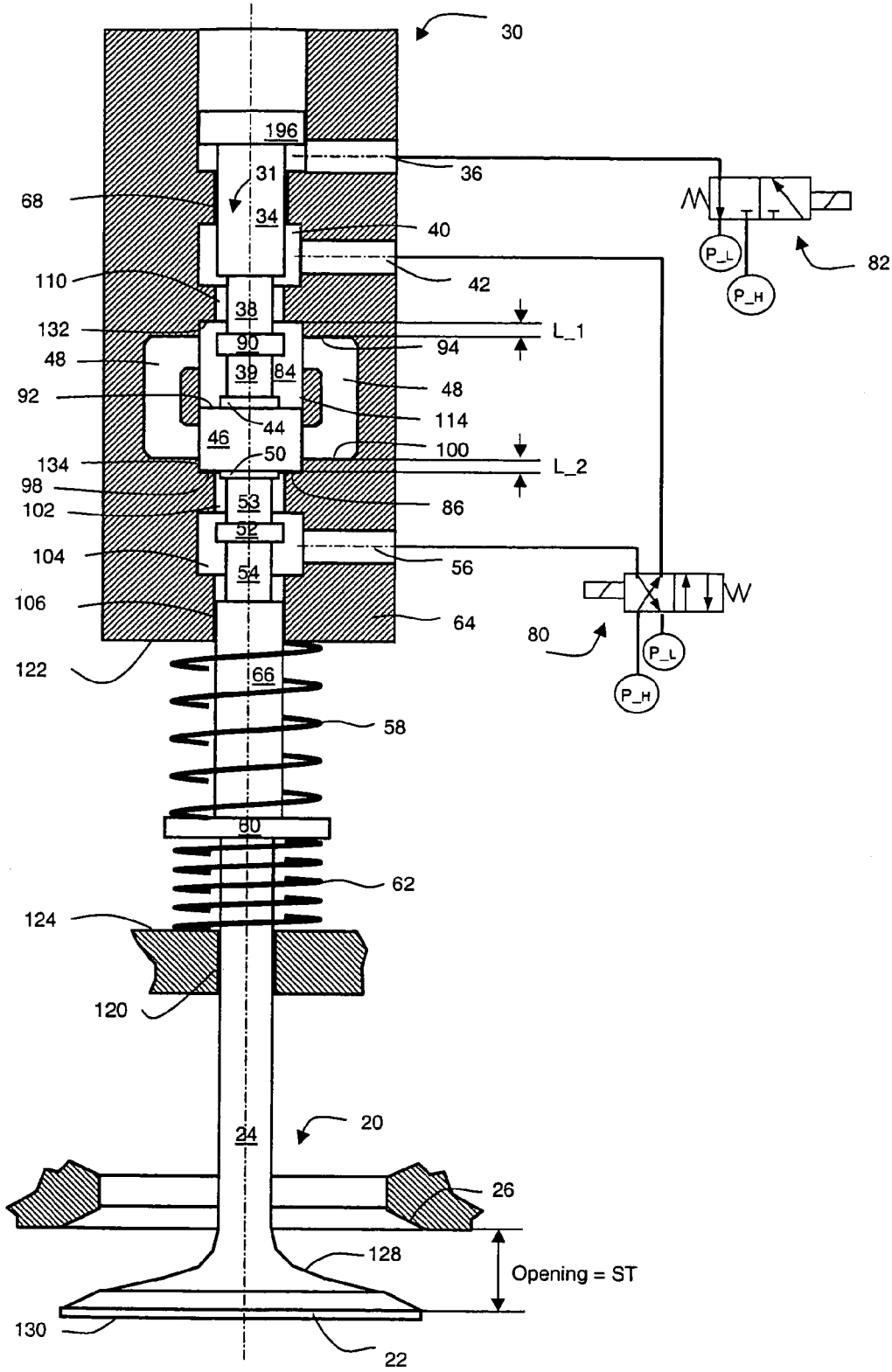
FIG. 7 is a schematic illustration of one preferred embodiment with the engine valve fully open.

As the second shoulder 50 penetrates deeper into the second control bore 102, the resulting flow restriction generates a dynamic pressure rise in the second fluid space 86, resulting in a dynamic snubbing force in the first direction to slow down the shaft assembly 31 and the engine valve 20. The snubbing force increases with the travel and travel velocity and drops to zero when the travel stops There are therefore three primary forces: the spring force in the first direction, the static hydraulic force in the second direction, and the dynamic snubbing force in the first direction. The spring force resists and slows down the engine valve opening. The static hydraulic force assists the engine valve opening, especially if there has been excessive energy loss along the way and not enough kinetic energy in the shaft assembly 31 and the engine valve 20 for them to travel all the way to a full opening. The snubbing force tends to slow down the shaft assembly 31 and the engine valve 20 if they travel too fast before the actuation piston 46 hits the actuation cylinder 114. At the full opening as shown in FIG. 7, the snubbing force disappears, and the static hydraulic force should be large enough to hold the engine valve 20 in place against the net spring force and other minor forces.

Valve Closing

Closing the engine valve is effectively a reversal of the opening process just described. It is triggered by turning the actuation switch valve 80 to its default or right position as shown in FIG. 3. Upon completion, the hydraulic actuator 30 and the engine valve 20 are back to their default states as shown in FIG. 3.

Figure 8:
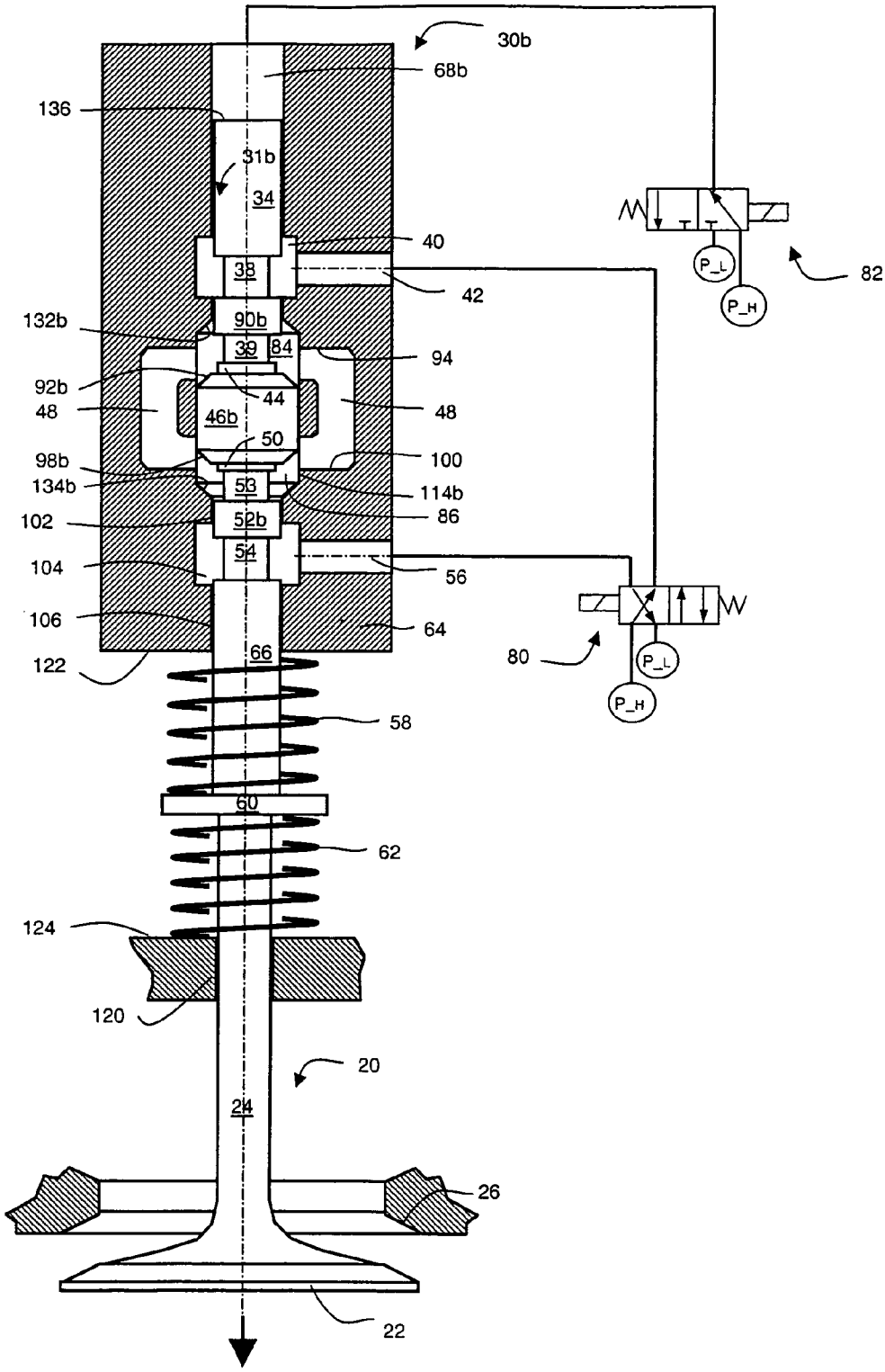
FIG. 8 is a schematic illustration of another preferred embodiment which utilizes the first piston rod directly as the start mechanism. It also features tapered end surfaces of the actuation piston and cylinder.

FIG. 8 depicts an alternative embodiment of the invention. The primary physical difference between this embodiment and that illustrated in FIGS. 1 through 7 lies in the start-up mechanism. This alternative configuration does not include a start piston, but instead utilizes a combination of the first piston rod 34 and a new first bearing 68*b*, which is more extended longitudinally than the first bearing 68 in FIGS. 1-7.

In operation, the start switch valve 82 is turned to its start or right position as shown in FIG. 8 and supplies the high pressure P_H fluid to the first bearing 68*b*, resulting in a hydraulic force on the first-piston-rod end surface 136, which pushes the shaft assembly 31*b* and the engine valve 20 to the full open position. To complete the initialization, the actuation switch valve 80 has to be turned to its left position as shown in FIG. 8 so that the first and second chambers 40 and 104 are supplied with the high pressure P_H and low pressure P_L fluids, respectively.

Once the start-up is complete, this embodiment operates like the embodiment in FIGS. 1 through 7. This alternative embodiment has a simpler starting mechanism, but application may be limited by the available space between the fully-opened engine valve 20 and the top of the engine piston at the top dead center to avoid physical interference or impact. This embodiment also features tapered end surfaces for the actuation piston 46*b* and actuation cylinder 114*b*. When the actuation piston second surface 98*b* hits the actuation cylinder second end 134*b*, the tapered surfaces may have better stress distribution and longer service life. Although in a preferable design, the actuation piston first surface 92*b* will never hit the actuation cylinder first end 132*b*, still their tapered shape may help release local stress caused by high snubbing pressure. To achieve the same flow blocking function and logic, the first and second lands 90*b* and 52*b* are extended in their lengths compared with the lands in other preferred embodiments.

Figure 9:
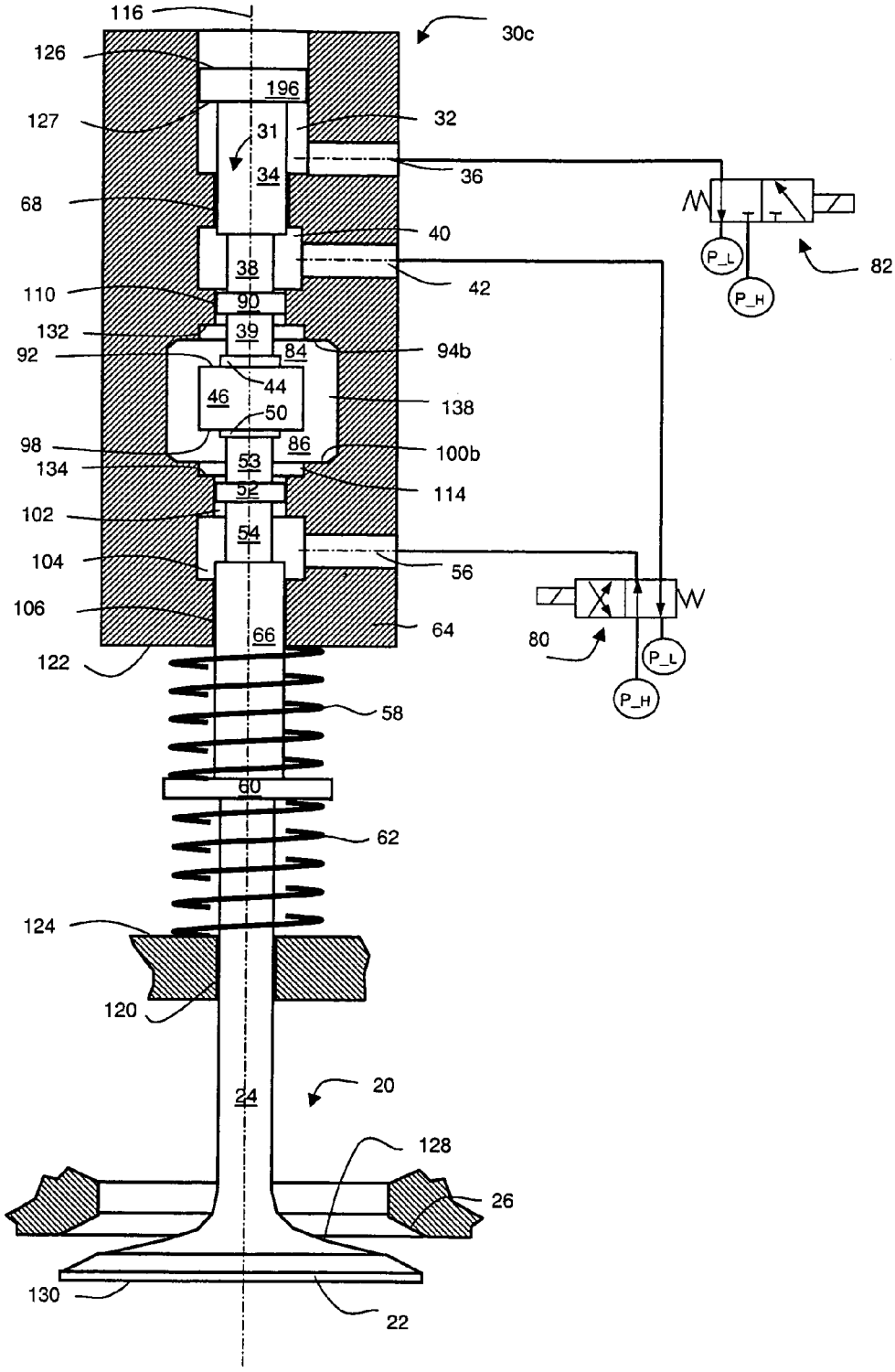
FIG. 9 is a schematic illustration of another preferred embodiment which has in the actuation cylinder one or more undercuts as the bypass.

Refer now to FIG. 9, there is a drawing of another alternative embodiment of the invention. The main physical difference between this embodiment and that illustrated in FIGS. 1 through 7 lies in the design of the bypass in the actuation cylinder 114. In this embodiment, the bypass is one or more bypass undercuts 138. This design provides smoother or freer bypass flow around the actuation piston 46 between the first and second edges 94*b* and 100*b* and less friction on the piston 46.

Figure 10:
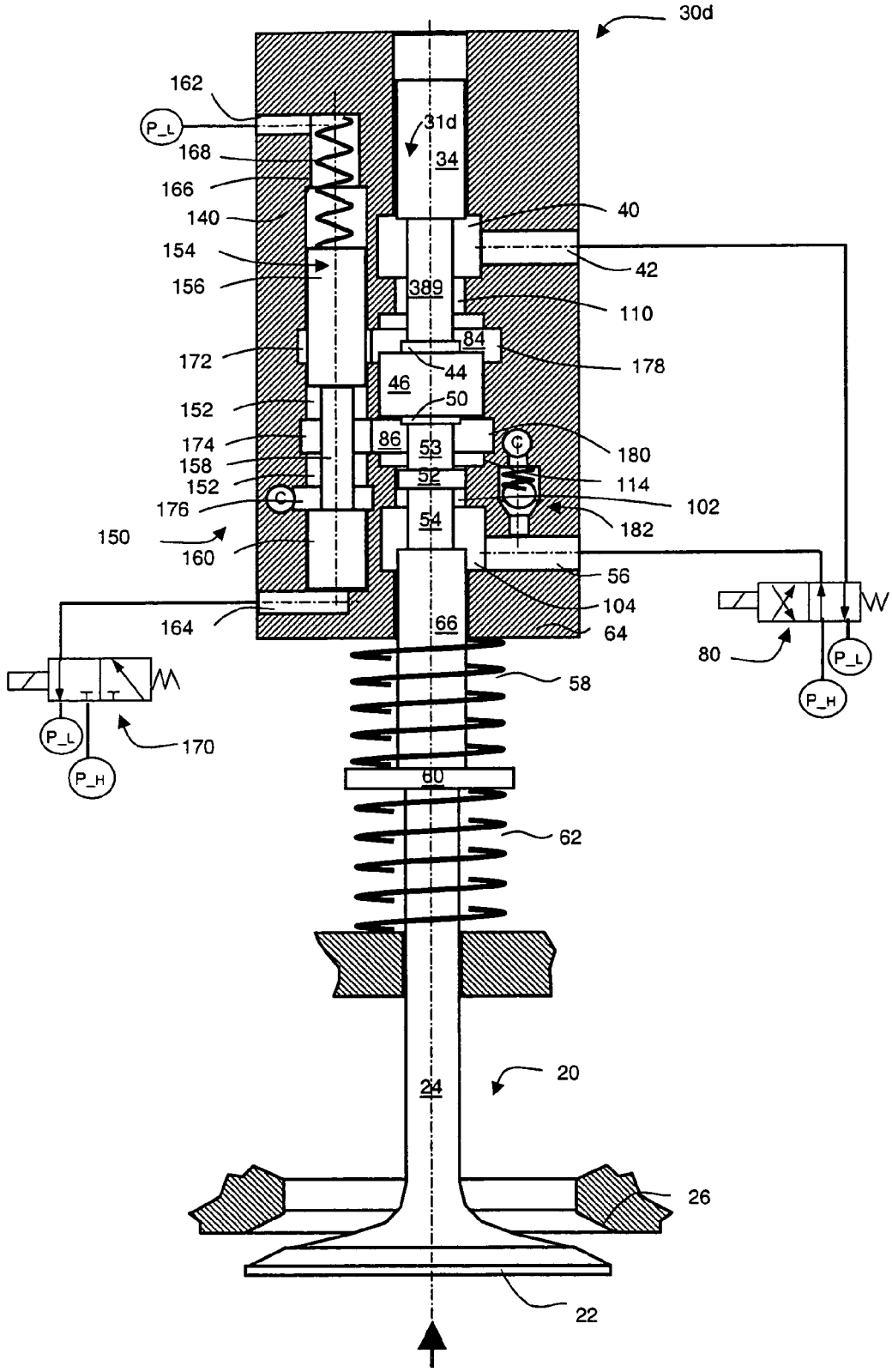
FIG. 10 is a schematic illustration of the start-up process of another preferred embodiment.

Refer now to FIG. 10, which is a drawing of yet another alternative embodiment of the invention. Compared with the embodiment in FIG. 8, this embodiment is different primarily in its start mechanism 150, which is designed to block a bypass passage 152, preferably the only bypass passage around the actuation cylinder 114. Also, the shaft assembly 31*d* does not include the first land 90*b* as in FIG. 8, resulting in an extended neck 389. The reason for the elimination of the first land 90 will become clear when the operation of this embodiment is explained below.

The start mechanism 150 includes a start shaft 154 comprising a first head 156, a second head 160 and a stem 158 in between the two heads 156 and 160. The start shaft 154 moves inside the bypass passage 152, which is extended longitudinally beyond the length necessary for the bypass flow function to accommodate the whole length of the start shaft 154. Two ends of the bypass passage 152 are hydraulically connected to start first and second ports 162 and 164, respectively. Between the bypass passage 152 and the start first port 162, there is a smaller passage 166, offering a limit shoulder 140 to offer the limit in the first direction for the movement of the start shaft 154. A return spring 168 resides inside the small passage 166 and, when the start shaft 154 is not all the way against the limit shoulder 140, a part of the bypass passage 152 to urge the start shaft towards the second direction. The start first port 162 is always connected with the low pressure P_L line, whereas the start second port 164 is connected with either the high pressure P_H or low pressure P_L lines through the start switch valve 170.

The bypass passage 152 and the start shaft 154 have a reasonable radial clearance to ensure a smooth sliding movement for the shaft 154 and minimum hydraulic leakage. From the first to the second direction along the longitudinal axis of the bypass passage 152, there are a first bypass groove 172, a second bypass groove 174 and a check valve groove 176. From the first to the second direction along the longitudinal axis of the actuation cylinder 114, there are a first actuation cylinder groove 178 and a second actuation cylinder groove 180. These five grooves are intended to reduce or eliminate hydraulic force imbalance on the start shaft 154 and the actuation piston 46 and to facilitate the reduction of the flow resistance. The first bypass groove 172 is in hydraulic communication with the first actuation cylinder groove 178, whereas the second bypass groove 174 is in hydraulic communication with the second actuation cylinder groove 180. The check valve groove 176 is in hydraulic communication, C-to-C, with the downstream side of a check valve 182, whereas the upstream end of the check valve 182 is in hydraulic communication with the second port 56 or, not shown in FIG. 10, with the second chamber 104.

In start operation as shown in FIG. 10, the start switch valve 170 is energized and set at the left position, connecting the start second port 164 to the low pressure P_L line. The start shaft 154 is pushed by the return spring 168 in the second direction and blocks, with the first head 156, the first bypass groove 172 and the bypass passage 152, and the actuation piston 46 functions like a normal piston. Also, the actuation switch valve 80 is in its default or right position, connecting the first and second ports 42 and 56 to the low pressure P_L and high pressure P_H lines, respectively. The first fluid space 84 is now exposed the low pressure P_L because it is in hydraulic communication with the first port 42 though the first chamber 40 and the first control bore 110, which is not blocked by the first land 90*b* as in FIG. 8.

Although the second control bore 102 is blocked by the second land 52, the second fluid space 86 is still exposed to the high pressure P_H because it is in hydraulic communication with the second port 56 through the check valve 182, the hydraulic communication C-to-C, the check valve groove 176, a portion of the bypass passage 152, the second bypass groove 174, and the second actuation cylinder groove 180. The resulting differential pressure pushes the actuation piston 46 and thus the shaft assembly 31*d* and engine valve 20 all the way to the fully closed position, which completes the start-up process. Near the end of this travel, the second land 52 slides out the second control bore 102 to further ensure the connectivity between the second fluid space 86 and the second port 56.

Figure 11:
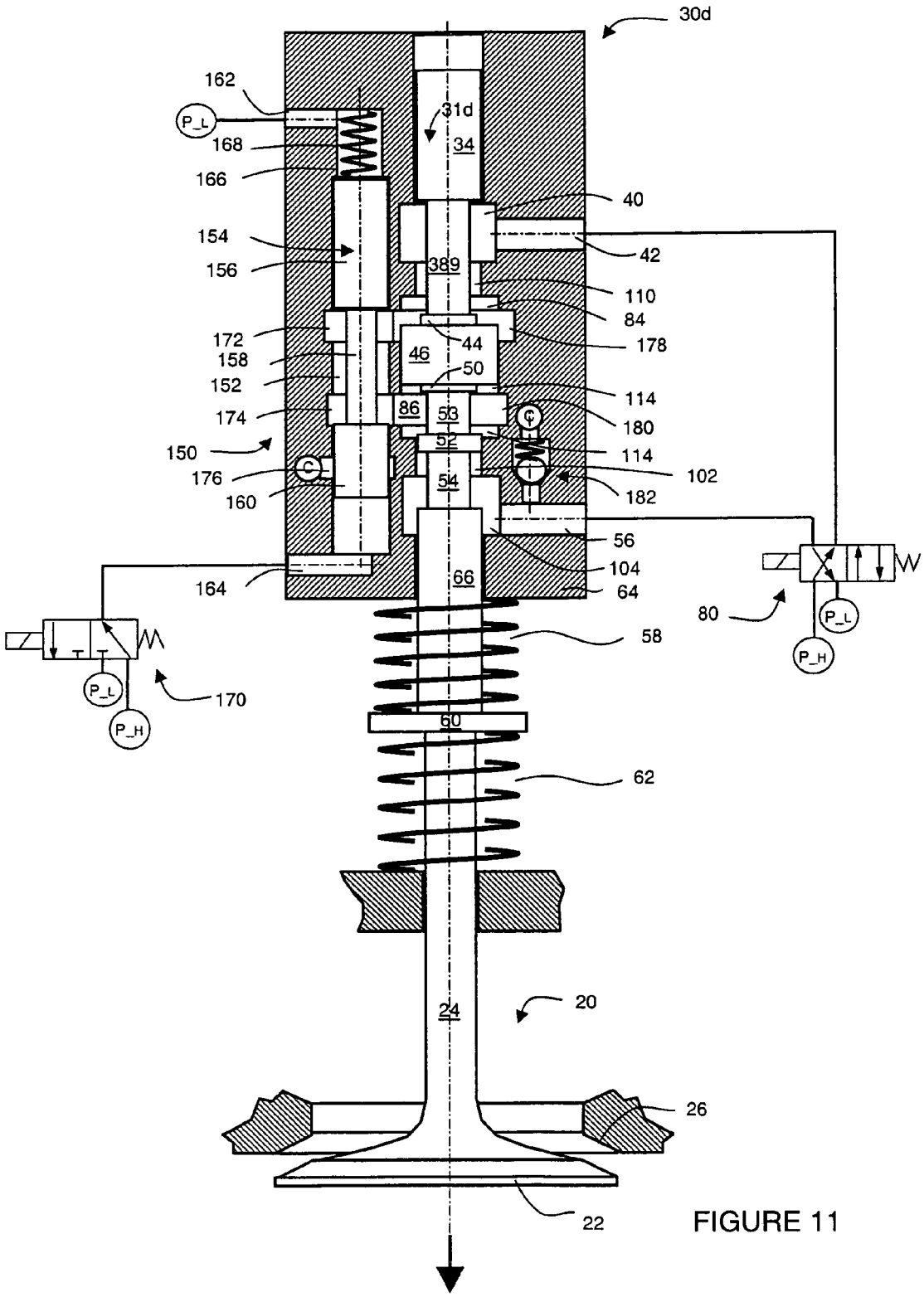
FIG. 11 is a schematic illustration of the engine valve opening process of another preferred embodiment which uses a shaft assembly to block a single bypass passage.

In normal operation as shown in FIG. 11, the start switch valve 170 is de-energized and returned to its default or right position to keep the start second port 164 pressurized and to hold the start shaft 154 against the returning spring 168, resulting in a substantially open bypass passage 152 and a blocked check valve groove 176, which disables the check valve 182. Thus, hydraulic actuator 31*d* in FIG. 11 functions much like the hydraulic actuator 31*b* in FIG. 8, except that in FIG. 11 there is only one blocking land, the second land 52 to block the free flow between the first and second ports 42 and 56 during the middle portion of a stroke when the bypass passage 152 is open.

In an engine valve opening stroke as illustrated in FIG. 11, the actuation switch valve 80 is de-energized or at its left position and connects the first and second ports 42 and 56 to the high pressure P_H and low pressure P_L lines, respectively, and the actuation piston 46 has moved to the middle range of the movement in the second direction where the bypass passage 152 is open. At this point, the entire actuation cylinder 114 is exposed to high pressure P_H through the bypass passage 152 and first control bore 110. The net hydraulic force on the actuation piston 46 is still equal to zero. Therefore, the elimination of the first land 90 or 90*b* does not fundamentally change the function of the system although it may introduce a little more flow leakage between the first and second ports 42 and 56 because it eliminates one of the two main barriers in the flow path. It is also workable to eliminate the first land 90 or 90*b* in other preferred embodiments in FIGS. 1-9.

Figure 12:
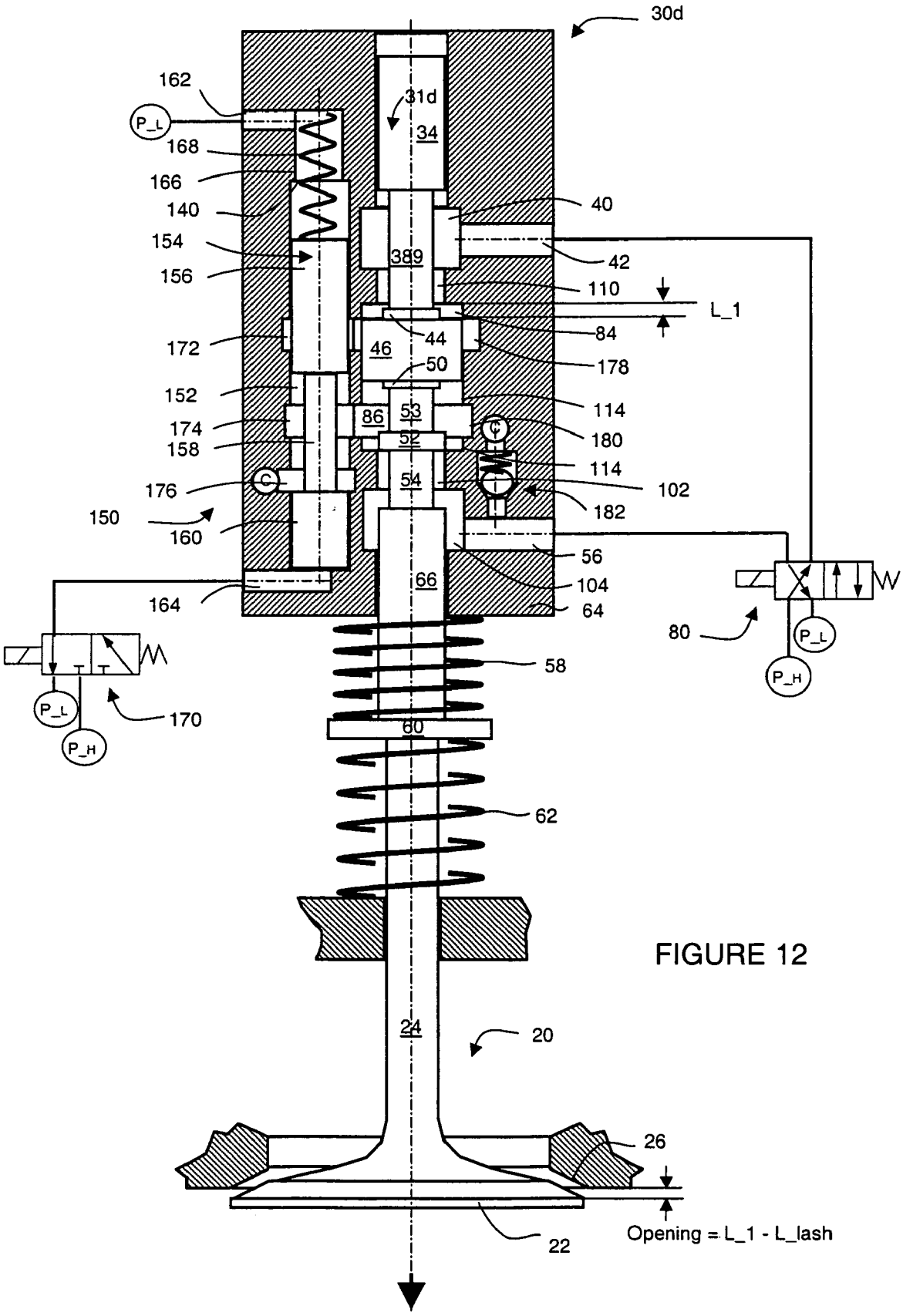
FIG. 12 is a schematic illustration of the short valve lift opening process of another preferred embodiment which uses a shaft assembly to block a single bypass passage.

This latest embodiment is also able to drive the engine valve 20 with a small lift, which is a great plus for engine calibration and control strategy. As shown in FIG. 12, the actuation switch valve 80 is at its left position, and the hydraulic assembly 31*d* is in a travel in the second direction. However, the start switch valve 170 is at its left position, and the start shaft 154 is at its lower position, blocking the bypass passage 152.

As shown in FIG. 12, the actuation piston 46 has just traveled a distance of (L_1-L_lash), and the second land 52 is about to enter the second control bore 102. At this point, the second fluid space 86 is a closed or trapped volume, without hydraulic communication with anyone of the ports 42 and 56. Any further motion in the second direction by the actuation piston 46 will cause a volume reduction and pressurization. The total piston travel is thus limited, barring any severe leakage, to not too much more than (L_1-L_lash).

Once the actuation switch valve 80 is turned to the right position and connects the first and second ports 42 and 56 to low pressure P_L and P_H lines, respectively, the high pressure fluid will enter the closed second fluid space 86 through the check valve 182 and the C-to-C connection. Shortly after that, the second land 52 is out of the second control bore 102, and the high-pressure fluid can flow more freely into the second fluid space 86 and complete the return stroke, against the spring force, which intends to push the assembly to the neutral or middle position. During this short lift operation, the two springs 62 and 58 cannot contribute much, and entire operation has to be sustained by the hydraulic system, which is still feasible because of the shorter stroke.

Figure 13:
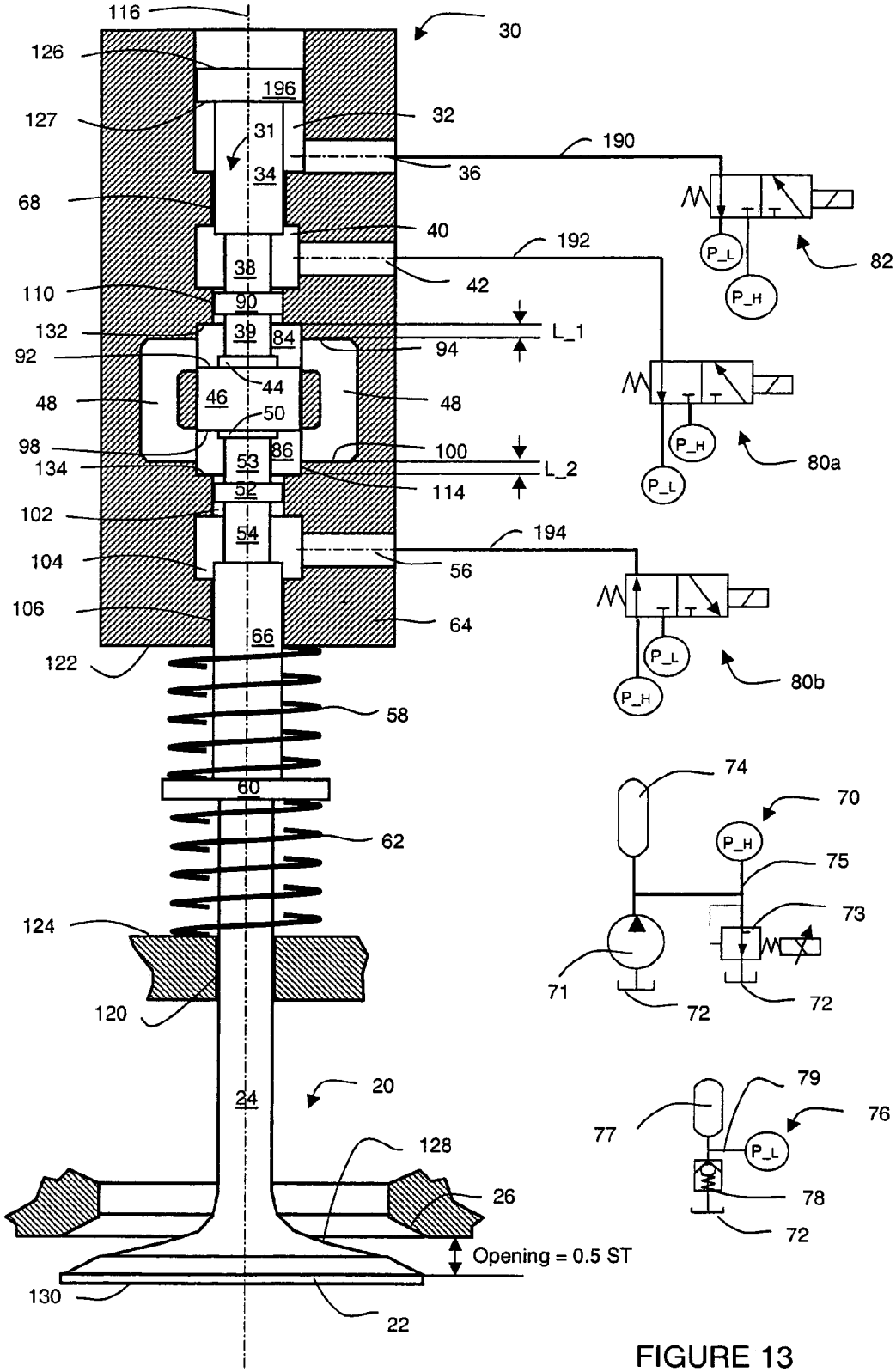
FIG. 13 is an alternate embodiment of the device illustrated in FIG. 1.

Various switch valves 80, 82, and 170 in FIGS. 1-12 are used for the illustration purpose only and should not be considered to be the only valves that can be used. For example, the actuation switch valve 80 may be replaced by two 2-position 3-way valves 80*a* and 80*b*, each of them being able to control one of the two fluid lines 192 and 194 for its connection with the high pressure P_H and low pressure P_L lines as shown in FIG. 13. In general, a 3-way valve is easier to manufacture than a 4-way valve.

One can purposely introduce a time delay between the actions of the two actuation switch valves 80*a* and 80*b* for certain functions. During the engine valve opening operation, for example, one can reduce the hydraulic energy input at the beginning of the stroke by delaying the switch of the valve 80*a* and thus keeping the first chamber 40 at low pressure P_L a little bit longer, which may be desirable if the engine air cylinder pressure is expected to be low. Also, either or both of the two switch valves 80 and 82 may be controlled by two, instead of one, solenoids. This flexibility in valve selection applies to other preferred embodiments as well.

Although in each of the illustrations, there are one start switch valve and one actuation switch valve for each hydraulic actuator or engine valve, this need not be the case. As many modern engines have two intake and/or two exhaust valves per engine cylinder, one actuation switch valve may simultaneously control two intake or exhaust valves on the same engine cylinder if the control strategy does not call for asymmetric opening. One start switch valve may control all the engine valves in an entire engine.

Also in many illustrations and descriptions, the fluid medium is defaulted to be hydraulic or of liquid form. In most cases, the same concepts can be applied with proper scaling to pneumatic actuators and systems. As such, the term "fluid" as used herein is meant to include both liquids and gases. Also in many illustrations and descriptions so far, the application of the hydraulic actuator 30 is defaulted to be in engine valve control, and it is not limited so. The hydraulic actuator 30 can be applied to other situations where a fast and/or energy efficient control of the motion is needed.

Although the present invention has been described with reference to the preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of this invention.

I claim:

1. An actuator, comprising:

a housing having first and second fluid ports at different fluid pressures;

an actuation cylinder in the housing defining a longitudinal axis and having first and second ends in first and second directions;

an actuation piston in the cylinder with first and second surfaces moveable along the longitudinal axis;

first and second actuation springs biasing the actuation piston in the first and second directions, respectively;

a first fluid space defined by the first end of the actuation cylinder and the first surface of the actuation piston;

a second fluid space defined by the second end of the actuation cylinder and the second surface of the actuation piston;

a fluid bypass in fluid communication with only the first and second fluid spaces, the fluid bypass being operative to short-circuit the first and second fluid spaces when the actuation piston is not substantially proximate to either the first or second end of the actuation cylinder;

a first flow mechanism in fluid communication between the first fluid space and the first port; and a second flow mechanism in fluid communication between the second fluid space and the second port.

2. The actuator of claim 1, wherein the first and second flow mechanisms include a variable metering capability.

3. The actuator of claim 1, wherein:

at least one of the flow mechanisms is at least partially closed when the fluid bypass is substantially open; and both flow mechanisms are at least partially open when the fluid bypass is substantially closed.

4. The actuator of claim 1, wherein:

a first piston rod is connected to the first surface of the actuation piston, the first piston rod including first and second necks having outside dimensions;

a second piston rod is connected to the second surface of the actuation piston, the second piston rod also including first and second necks having outside dimensions;

the first flow mechanism includes a first land with an outside dimension and a first control bore having an inside dimension;

the second flow mechanism includes a second land with an outside dimension and a second control bore having an inside dimension;

the inside dimension of the first control bore is slightly larger than the outside dimension of the first land and substantially larger than the outside dimensions of the first and second necks of the first piston rod, and the first land longitudinally overlaps the first control bore when the fluid bypass is substantially open; and the inside dimension of the second control bore is slightly larger than the outside dimension of the second land and substantially larger than the outside dimensions of the first and second necks of the second piston rod, and the second land longitudinally overlaps the second control bore when the fluid bypass is substantially open.

5. The actuator of claim 4, further including a first shoulder longitudinally situated between the first-piston-rod first neck and the first surface of the actuation piston and a second shoulder longitudinally situated between the second-piston-rod first neck and the second surface of the actuation piston, the first shoulder having an outer dimension that is smaller than the inside dimension of the first control bore yet large enough to generate a substantial flow restriction or snubbing action when the first shoulder overlaps longitudinally the first control bore; and the second shoulder having an outer dimension that is smaller than the inside dimension of the second control bore yet large enough to generate a substantial flow restriction or snubbing action when the second shoulder overlaps longitudinally the second control bore.

6. The actuator of claim 1, wherein the fluid bypass includes at least one passage with at lease one opening near each of the first and second ends of the actuation cylinder.

7. The actuator of claim 1 wherein the fluid bypass includes at least one undercut in the actuation cylinder.

8. The actuator of claim 1, further including a hydraulic or pneumatic control to initialize the actuation piston.

9. The actuator of claim 1, further including a start piston used to initialize the actuator.

10. The actuator of claim 1, further including:

a start control operative to open and close the fluid bypass; and at least one flow supply feeding at least one of the first and second fluid spaces.

11. The actuator of claim 10, wherein the flow supply includes a check-valve that allows fluid into, and not out of, the second fluid space through a passage that is not blocked when the start control closes the bypass.

12. The actuator of claim 1, further including an engine valve operably connected to the actuation piston.

13. The actuator of claim 12, further including an engine valve lash adjustment.

14. The actuator of claim 1, further including one or more snubbers to dampen the speed of the actuation piston when travel approaches either end of the actuation cylinder.

15. The actuator of claim 1, wherein the first and second ends of the actuation cylinder and the first and second surfaces of the actuation piston are tapered.

16. The actuator of claim 1, further including a four-way actuation switch valve to supply the first and second ports with high- and low-pressure fluid to drive the actuation piston in the first and second directions.

17. The actuator of clalm 1, further including two three-way actuation switch valves, each of which alternately supplies one of the first and second ports with high- and low-pressure fluid.

18. An engine air exchange regulator, comprising:

an actuator housing;

an actuation cylinder in the actuator housing, defining a longitudinal axis with a first and second direction and comprising a first end in the first direction and a second end in the second direction;

an actuation piston disposed in the actuation cylinder and moveable along the longitudinal axis in the first and second direction, the actuation piston comprising first and second surfaces;

a first piston rod connected to the first surface of the actuation piston and disposed slideably inside a first bearing along the longitudinal axis, distal to the first end of the actuation cylinder;

a second piston rod connected to the second surface of the actuation piston and disposed slideably inside a second bearing along the longitudinal axis, distal to the second end of the actuation cylinder;

a first fluid space defined by the first end of the actuation cylinder and the first-surface of the actuation piston and a second fluid space defined by the second end of the actuation cylinder and the second surface of the actuation piston;

a bypass in fluid communication with only the first and second fluid spaces, the fluid bypass being operative to hydraulically or pneumatically short-circuit the first and second fluid spaces when the actuation piston is not proximate to either of the first or second end of the actuation cylinder, first and second ports at different fluid pressures in the actuator housing;

a first flow mechanism between the first fluid space and the first port;

a second flow mechanism between the second fluid space and the second port;

first and second actuations spring biasing the actuation piston in the first and second directions;

an engine valve operably connected to the second piston rod; and one or more snubbers, whereby the speed of the actuation piston is substantially damped when the piston travels approaching either of the first and second ends of the actuation cylinder.

19. The engine air exchange regulator of claim 18, wherein:

the first piston rod further comprises, proximate to the second surface of the actuation piston, an extended neck, which forms a first annular space with a first control bore in the cylinder distal to the first end of the actuation cylinder, with the first annular space being part of the first flow mechanism;

the second piston rod further comprises, proximate to the second surface of the actuation piston, a first neck, a land and second neck;

the second flow mechanism includes a second annular space formed between the second piston rod and a second control bore along the longitudinal axis immediately proximate to the second end of the actuation cylinder;

the second control bore being followed, along the longitudinal axis, by a second chamber, which has a larger cross-section area than the second control bore;

the dimension of the land being smaller than but substantially close to that of the second control bore, whereby the second annular space being substantially open and closed for fluid flow when the land underlaps and overlaps, respectively, longitudinally the second control bore; and with the land being so geometrically positioned on the second piston rod that it overlaps the second control bore when the bypass short-circuits the first and second fluid spaces.

20. The engine air exchange regulator of claim 18, wherein:

the first piston rod further comprises, in spatial order distal to the first surface of the actuation piston, a first-piston-rod first neck, first land and first-piston-rod second neck;

the first flow mechanism including a first annular space formed between the first piston rod and a first control bore along the longitudinal axis, right next to the first end of the actuation cylinder;

with the first control bore being followed, along the longitudinal axis, by a first chamber, which has a larger cross-section area than the first control bore;

with the dimension of the first land being slightiy smaller than but substantially close to that of the first control bore, whereby the first annular space being substantially open and closed for fluid flow when the first land underlaps and overlaps, respectively, longitudinally the first control bore;

with the first land being so geometrically positioned on the first piston rod that it overlaps the first control bore when the bypass short-circuits the first and second fluid spaces;

the second piston rod comprising, in their spatial order distal to the second surface of the actuation piston, a second-piston-rod first neck, second land and second-piston-rod second neck;

the second flow mechanism including a second annular space formed between the second piston rod and a second control bore along the Longitudinal axis, right next to the second end of the actuation cylinder;

the second control bore being followed, along the longitudinal axis, by a second chamber, which has a larger cross-section area than the second control bore;

the dimension of the second land being slightly smaller than but substantially close to that of the second control bore, whereby the second annular space being substantially open and closed for fluid flow when the second land underlaps and overlaps, respectively, longitudinally the second control bore; and the second land being so geometrically positioned on the second piston rod that it overlaps the second control bore when the bypass short-circuits the first and second fluid spaces.

21. The engine air exchange regulator of clalm 18, further including a four-way actuation switch valve, whereby supplying the first and second ports with high-pressure and low-pressure fluid, respectively, to drive the actuation piston in the second direction and with low-pressure and high-pressure fluid, respectively, to drive the actuation piston in the first direction.

22. The engine air exchange regulator of claim 17, further including two three-way actuation switch valves, each of which alternately supplies one of the first and second ports with high- and low-pressure fluid.

* * * * *